US005096335A

United States Patent [19]

Anderson et al.

[11] Patent Number: 5,096,335

[45] Date of Patent: Mar. 17, 1992

[54] POLYMER GRID FOR SUPPLEMENTAL ROOF AND RIB SUPPORT OF COMBUSTIBLE UNDERGROUND OPENINGS

[75] Inventors: Ronald P. Anderson, Riverdale; Kenneth W. Miller, Fayetteville; William S. Shelton, Lithonia, all of Ga.

[73] Assignee: The Tensar Corporation, Morrow, Ga.

[21] Appl. No.: 675,616

[22] Filed: Mar. 27, 1991

[51] Int. Cl.[5] ..... E21D 19/00

[52] U.S. Cl. ..... 405/288; 405/150.1

[58] Field of Search ..... 405/150, 258, 259, 284, 405/288, DIG. 7; 299/11

[56] References Cited

U.S. PATENT DOCUMENTS 4,003,208 1/1977 Hornug et al. .
4,135,958 1/1979 Wood .
4,230,371 10/1980 Bell et al. .
4,237,182 12/1980 Fulmer et al. .
4,245,926 1/1981 Asszonyi et al. .
4,247,221 1/1981 Lewer et al. ..... 405/150
4,251,168 2/1981 Groetschel ..... 405/288
4,379,660 4/1983 Groetschel ..... 405/288
4,466,758 8/1984 Hinterreiter .
4,740,111 4/1988 Gagnon ..... 405/259
4,856,939 8/1989 Hilfiker ..... 405/284

*Primary Examiner*—David H. Corbin
*Attorney, Agent, or Firm*—Fleit, Jacobson, Cohn, Price, Holman & Stern

[57] ABSTRACT

A high-strength, lightweight flame-retardant and/or self-extinguishing polymer grid is provided for supplemental support of the roof and ribs of a combustible underground opening, such as within a coal mine, to prevent roof materials from falling and/or rib materials from spalling. The preferred polymer grid structure is formed of a polypropylene compounded with flame retardant additives.

9 Claims, 2 Drawing Sheets

POLYMER GRID FOR SUPPLEMENTAL ROOF AND RIB SUPPORT OF COMBUSTIBLE UNDERGROUND OPENINGS

FIELD OF THE INVENTION

This invention relates to a self-extinguishing, non-flame propagating, high-strength, lightweight polymer grid structure applied to the roof and/or ribs of underground openings which possess the hazards of methane and dusts containing volatile matter, e.g. mine categories, I, II, III and V per the Code of Federal Regulations, Title 30, Part 57, Section 22003, dated July 1, 1990, incorporated herein by reference (herein referred to as "combustible underground openings").

BACKGROUND OF THE INVENTION

Primary roof and rib control of underground openings is traditionally accomplished by metallic supports that may have a variety of configurations. Perhaps the most common are steel rock bolts which are generally spaced on a regular pattern within the roof, and sometimes sidewalls (ribs) of the openings. These primary support devices are intended to prevent catastrophic failure of the openings; they are generally not suited to prevent localized failure (i.e. debris falls or spalls) between their isolated locations. Herein lies the application of supplemental (or secondary) roof and rib control (support).

Underground mines and tunnels presently employ steel products, such as welded wire mesh, chain-link fence and/or expanded metal screen for supplemental support of their openings. These steel products are heavy and difficult to handle. Further, their edges are very sharp and are frequently the cause of mine or tunnel worker injuries. The steel products also impede extraction of the ore body (e.g. coal seam), since they are damaging to the cutting equipment used to extract the ore and/or soil and rock materials. Moreover, while steel products are resistant to combustion, they are subject to corrosion in the damp underground environments.

An example of a steel roof support is disclosed in U.S. Pat. No. 4,003,208 to Hornung et al. This patent discloses a shield support structure for preventing the falling of dust and debris from the roof and from the break of a coal mine. The assembly includes roof bars and a roof covering disposed between the roof of the mine and the roof bars. The roof covering includes a welded wire netting sheet having longitudinal and transverse wires with a dust-tight web welded or fixed in between the longitudinal and transverse wires.

Another example of a steel support of a roof of a coal mine is disclosed in U.S. Pat. No. 4,245,926 to Asszonyi et al. which discloses a welded grid structure for securing underground cavities. The welded grid structure includes two sets of grid systems of parallel straight bars disposed in parallel planes and connected by welding to a third set of bars that extend perpendicular to the first two set of bars.

An example of equipment for laying out a layer of elongate material made of wire mesh is disclosed in U.S. Pat. No. 4,230,371 to Bell et al. In this patent, equipment is disclosed for laying a layer of wire mesh adjacent to an exposed mine roof on the body of a mining machine, the equipment being cantilevered from the body of the machine into the newly formed track left directly behind the cutter.

Polymer grid products have previously been used to control roof caving during the recovery of shield supports in longwall mining of coal. The application of polymer grids was supplemental to primary roof control devices of rock bolts and cables, wire ropes, or threaded rebars. However, the term of use was temporary; that is, longwall shield recovery requires roof control serviceability for a period of no more than several days. Because the flammability hazard is usually very brief, the polymer grid products used were neither flame-retardant nor self-extinguishing.

This short-lived application of supplemental roof control is distinguished from the long-term application of supplemental roof and rib support of the instant invention wherein a permanent safeguard against materials which would otherwise contribute to hazards of fire or even explosion is necessary.

Indeed, the presence of metallic supporting material exacerbates the hazard because a spark can initiate an explosion and cause a fire. While replacement of metallic materials with polymeric materials minimizes the danger of sparking, non-flame-retardant and/or self-extinguishing polymer grid materials may sustain and spread a fire that has other origins. Thus, it is primarily the provision of a fire-retardant and/or self-extinguishing polymer grid as permanent supplemental support material in a combustible underground opening, such as within a coal mine, with which the instant invention is concerned.

While reference is made herein primarily to a combustible coal mine since the principal application of this invention will be in such environments, it is to be understood that the reference herein to a "combustible underground opening" is intended to apply more broadly to all such openings subject to the hazards of methane and dusts containing volatile matter presenting danger from explosion and fire as defined in Categories I, II, III and V of 37 C.F.R. §57.22003.

SUMMARY OF THE INVENTION

By the present invention, a polymer grid provides supplemental support to rock bolt anchors in room-and-pillar mining operations to prevent loose roof debris from falling and incompetent rib materials from spalling. The preferred polymer grid structure is formed of a polypropylene base with flame retardant additives. Such polymer grids come in large rolls of lightweight material which make installation simple, fast, safe and reliable. Moreover, the polymer grids do not impede pillar extraction process(es).

In room-and-pillar mining, the polymer grid is placed against the roof of the opening and secured tightly in this position by rock bolts that are drilled through the apertures of the grid and anchored with plates or washers. The polymer grid may also be secured in a similar fashion to the sidewall (rib) of the underground opening.

The polymer grid structure of the present invention is easy to handle and can be quickly installed in the roof and ribs of a mine or tunnel. The polymer grid is safer for laborers to work with, since it is lightweight and lacks sharp edges. Further, the flame retardant and/or self-extinguishing properties mitigate mine explosions and reduce the spread of fire that may occur in a combustible underground opening. The result is increased production efficiency, and decreased injury downtime.

Further, the polymer grid structure will not corrode in a damp environment. In addition, any accidental contact with the polymer grid structure will not damage ore extraction equipment or cause sharp metal pieces to break off and cause potential injury to mine workers.

It is an object of the present invention to provide a polymer grid structure along the roof of combustible underground openings, particularly within a coal mine, to prevent roof debris from falling from between rock bolt anchors.

It is another object of the present invention to provide a polymer grid structure along the ribs of combustible underground openings, particularly within coal mines, to prevent spalls from littering the opening and reducing the cross-sectioned bearing area of the pillar(s).

It is still yet another object of the present invention to provide a high-strength polymer grid structure along the roof and ribs of a combustible underground opening with flame-retardant and/or self-extinguishing, high strength, lightweight, non-corrosive characteristics.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
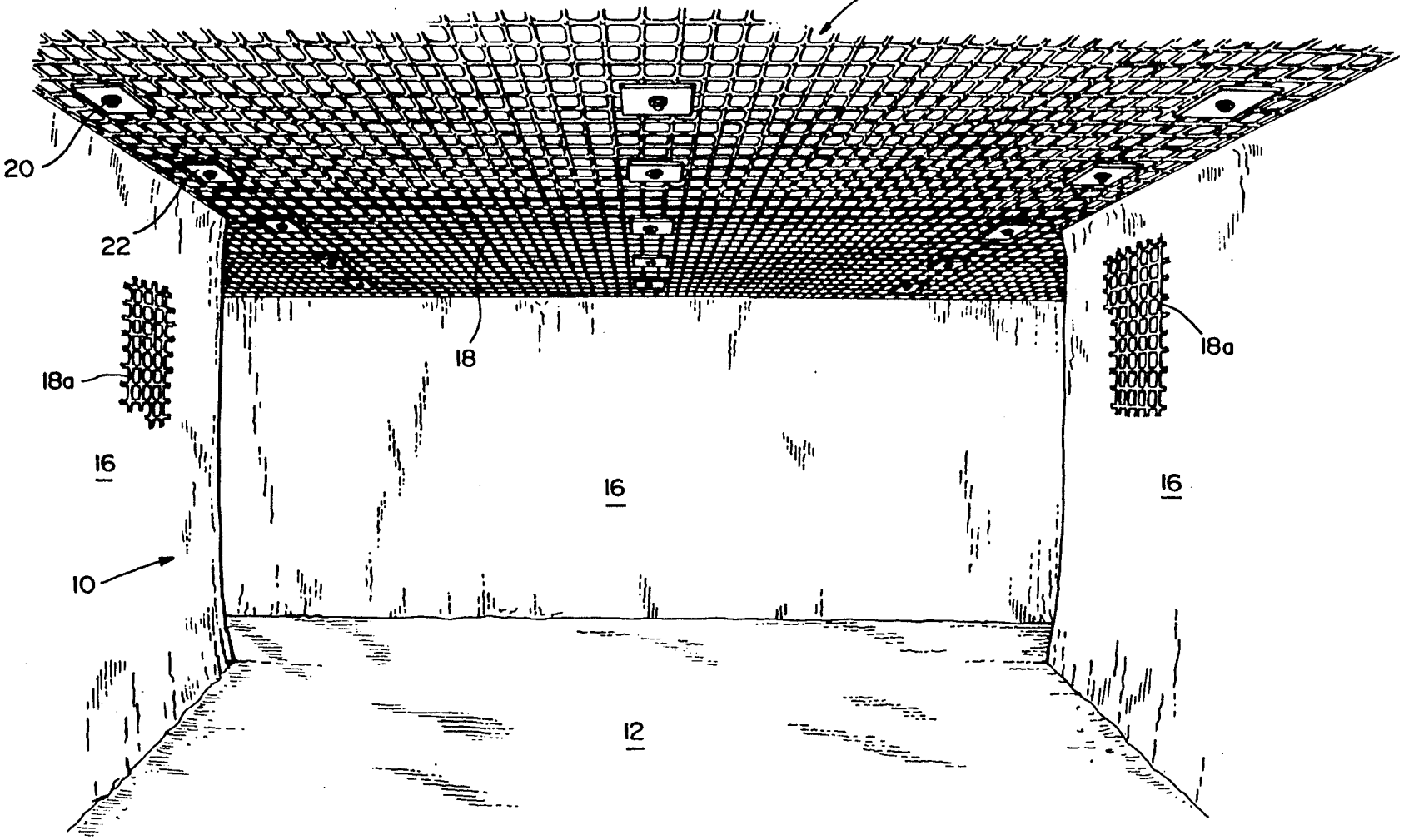
FIG. 1 is a perspective view of a combustible underground opening, such as within a coal mine.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

Figure 2:
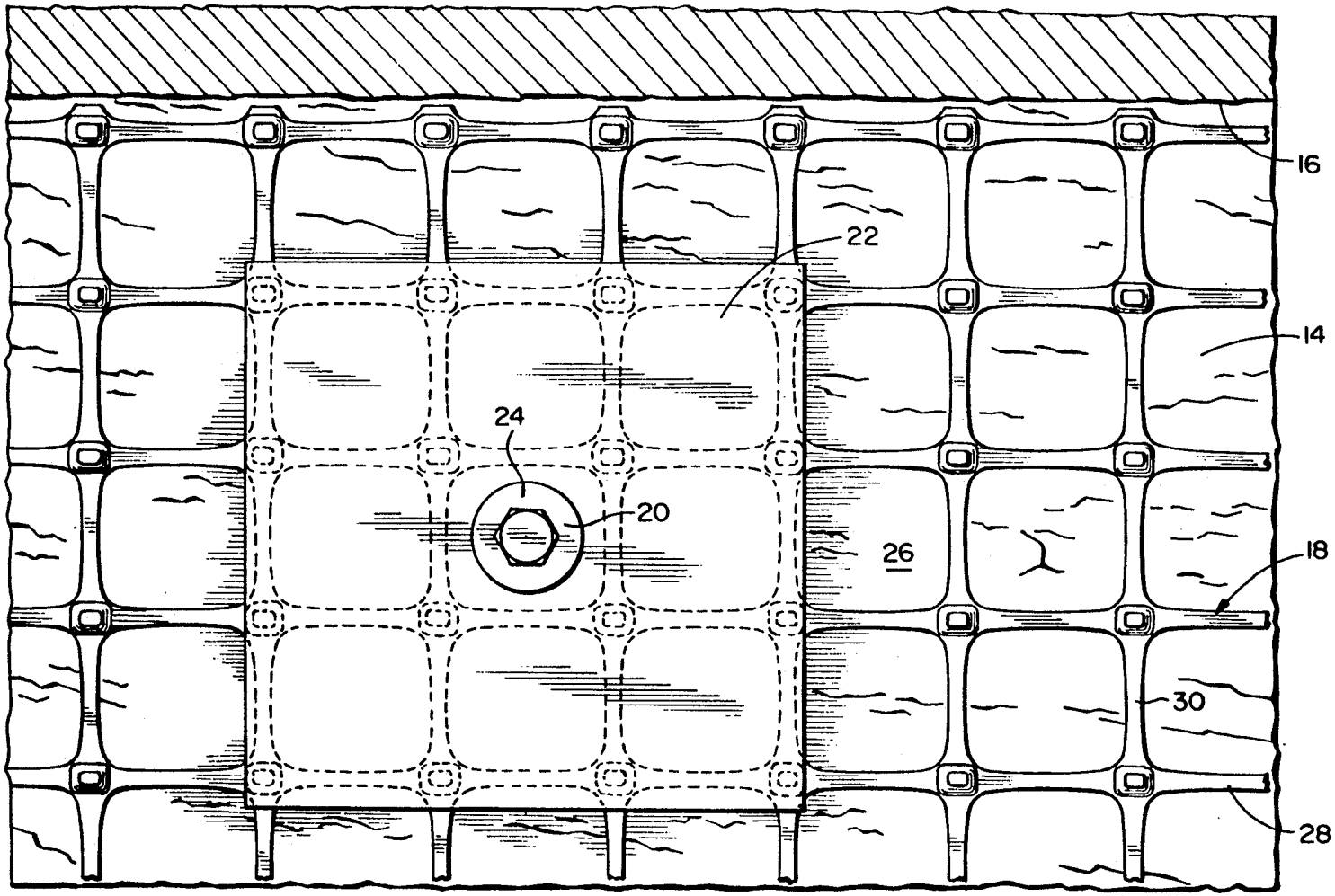
FIG. 2 is a bottom plan, partial sectional, view of a polymer grid secured to the roof and/or rib of the underground opening.

With reference to the drawings, in general, and to FIGS. 1 and 2, in particular, a system for supporting the roof and ribs of a combustible opening, particularly within a coal mine, with standard room-pillar application is shown. An underground mine opening is generally designated as 10 in FIG. 1. The underground opening includes a floor 12 and a roof 14 interconnected by a series of sidewalls (called ribs) 16 forming pillars or corridors.

A self-extinguishing, non-flame propagating, high strength polymer grid structure 18 lines the roof 14 of the underground opening 10. The same grid material, part of which is schematically shown at 18*a* in FIG. 1 may be used as a supplemental support for the ribs 16. The polymer grid structure 18 may be secured to the roof 14 by rock bolt anchors 20. The anchors are, for example, secured to the roof through an aperture of the plastic grid structure 18. The anchors 20 support a plate 22 up against the polymer grid structure 14 for securing the polymer grid structure 18 on the roof 14. The polymer grid structure prevents roof materials from falling in such a room-and-pillar mining operation.

As shown in FIG. 2, interposed between the anchor 20 and the plate 22 is a washer 24. The washer and the head of the anchor 20 are located centrally of an opening 26 defined by the longitudinal and transverse elements 28 and 30 of the polymer grid structure 18. Of course, a similar anchoring arrangement may be used to secure grid material 18*a* to the ribs of an underground opening. In a room-and-pillar mining operation, the polymer grid structure 18, 18*a* may be located along the roof of the rooms, as well as the ribs of the pillars. A pattern of rock bolts is spaced at regular patterns within the openings.

The preferred polymer grid structure 18, 18*a* is made of extruded, punched, and drawn sheet stock. Flame retardant and/or self-extinguishing polymer materials are well known and any such material can be selected for use in producing the grid material for the instant invention. A preferred material consists of a bromine-/antimony oxide flame retardant compounded with polypropylene to render the grid material flame retardant and/or self-extinguishing. Such a finished polymer grid structure having the desired properties for the present invention is available from The Tensar Corporation, of Morrow, Ga., under product code BX3316.

The preferred material is a grid structure which must have a V-O rating which is a material capable of passing UL-94 testing for plastic materials as performed by Underwriter's Laboratories. Passing of the UL-94 test method requires a specimen that does not drip flaming particles that would ignite dry absorbent surgical cotton placed twelve inches (305 mm) below the test specimen.

By the present invention, a self-extinguishing, lightweight, high-strength (minimum 1500 pounds per foot tensile strength), non-corrosive supplemental support to prevent roof materials from falling and rib materials from spalling into the openings of underground mines is provided. The polymer grid structure of the invention produces a safer environment for workers in a combustible underground opening, such as within a coal mine, at a significant installed cost savings.

Having described the invention, many modifications thereto will become apparent to those skilled in the art to which it pertains without deviation from the spirit of the invention as defined by the scope of the appended claims.

We claim:

1. In combination, a combustible underground opening and a polymer grid structure, said opening being defined by a roof, sidewalls, and a floor, said polymer grid structure being supported relative to at least at portion of said roof and sidewalls to prevent debris and spalls from falling onto the floor, said polymer grid structure including a flame retardant additive for preventing initiation of a spark which could initiate a fire or explosion within said combustible underground opening and for preventing propagation of a fire within said grid structure by a fire initiated elsewhere.

2. The combination of claim 1, wherein said combustible underground opening is a mine within a combustible ore body with the potential for liberating methane.

3. The combination of claim 2, wherein said mine is a coal mine.

4. The combination of claim 2, wherein said mine is a room-and-pillar mine.

5. The combination of claim 4, wherein said polymer grid structure is secured to at least a portion of said roof.

6. The combination of claim 4, wherein said polymer grid structure is secured to at least a portion of said sidewalls.

7. The combination of claim 4, wherein said polymer grid structure is secured to at least a portion of said roof and said sidewalls.

8. The combination of claim 4, wherein said polymer grid structure is secured to said walls by rock bolt anchors.

9. The combination of claim 1, wherein said polymer grid structure comprises polypropylene compounded with a flame retardant.

* * * * *